US010262611B2

(12) United States Patent
Chen et al.

(10) Patent No.: US 10,262,611 B2
(45) Date of Patent: Apr. 16, 2019

(54) DISPLAY DEVICE AND DISPLAY METHOD THEREOF

(71) Applicant: SILICON TOUCH TECHNOLOGY INC., Hsinchu (TW)

(72) Inventors: Kuei-Jyun Chen, Hsinchu (TW); Tao-Lun Darren Chin, Hsinchu (TW)

(73) Assignee: SILICON TOUCH TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/051,784

(22) Filed: Feb. 24, 2016

(65) Prior Publication Data

US 2017/0004762 A1 Jan. 5, 2017

(30) Foreign Application Priority Data

Jul. 3, 2015 (TW) ..... 104121651 A

(51) Int. Cl.
*G09G 3/36* (2006.01)
*G09G 3/20* (2006.01)

(52) U.S. Cl.
CPC ..... *G09G 3/3666* (2013.01); *G09G 3/2088* (2013.01); *G09G 2310/0205* (2013.01); *G09G 2320/0247* (2013.01); *G09G 2340/0407* (2013.01)

(58) Field of Classification Search
CPC .... G09G 3/32; G09G 2310/0202; G09G 3/30; G09G 2300/0439
See application file for complete search history.

(56) References Cited

U.S. PATENT DOCUMENTS 5,726,677 A * 3/1998 Imamura ..... G09G 3/3622 345/537
7,015,902 B2 3/2006 Nagai et al.
2002/0044782 A1 4/2002 Kota et al.
2002/0180719 A1 12/2002 Nagai et al.
2005/0057462 A1 3/2005 Kota et al.
(Continued)

FOREIGN PATENT DOCUMENTS

CN 1386259 A 12/2002
CN 101694551 A 4/2010
(Continued)

*Primary Examiner* — Kent W Chang
*Assistant Examiner* — Scott D Au
(74) *Attorney, Agent, or Firm* — Li & Cai Intellectual Property (USA) Office

(57) ABSTRACT

The present disclosure illustrates a display device. The displaying device comprises a display panel, at least one scan driving unit and a data driving unit. The display panel is divided into display regions respectively having pixel sets. At least one scan driving unit having scanning lines couples to the pixel sets. The at least one scan driving unit outputs scanning signals to corresponding display regions upon receiving a first control signal. The data driving unit outputs data signals to the corresponding display regions upon receiving a second control signal. In response to respectively receiving the first or second control signals, the scan driving unit outputs the scanning signals or the data driving unit outputs the data signals to the corresponding display regions, so as to simultaneously scan the display regions respectively having the pixel sets in sequence with corresponding scanning patterns.

10 Claims, 7 Drawing Sheets

(56) References Cited

U.S. PATENT DOCUMENTS

| | | | | |
|---|---|---|---|---|
| 2006/0181499 | A1 | 8/2006 | Li et al. | |
| 2006/0279489 | A1* | 12/2006 | Ouchi | G09G 3/20 345/76 |
| 2006/0290643 | A1* | 12/2006 | Sakamoto | G09G 3/3216 345/99 |
| 2008/0231586 | A1 | 9/2008 | Wang et al. | |
| 2008/0231587 | A1* | 9/2008 | Takahashi | G09G 3/3611 345/101 |
| 2014/0285535 | A1 | 9/2014 | Pyo | |
| 2014/0354621 | A1* | 12/2014 | Shin | G09G 3/3696 345/212 |
| 2015/0221129 | A1* | 8/2015 | Buron | G06T 15/005 345/420 |

FOREIGN PATENT DOCUMENTS

| | | | |
|---|---|---|---|
| JP | 2001209357 | A | 8/2001 |
| JP | 2002-123208 | A | 4/2002 |
| TW | 201523571 | A | 6/2015 |

* cited by examiner

DISPLAY DEVICE AND DISPLAY METHOD THEREOF

BACKGROUND

Field of Invention

The present disclosure relates to a display device. More particularly, the present disclosure relates to a display device which simultaneously scans a plurality of display regions and display method thereof.

Description of Related Art

Following the technology, the display devices are getting more mature. Traditionally an ultrahigh voltage mercury lamp has been applied to be the light source, such as the digital display device, front-projection type display device or cast-panel display device. However, the ultrahigh voltage mercury has a bad impact on the environment. For preventing polluting the environment, a light-emitting diode (LED) display device is proposed. The LED display device's volume is lighter and thinner, and mercury pollution will not occur. Thus, the traditional devices can be replaced by the LED display device.

Please refer to FIG. 1, which is a schematic diagram illustrating a conventional display device. The conventional display device 1 includes a display panel 10, a scan driving unit 11, and a data driving unit 12. The scan driving unit 11 has a plurality of scanning lines coupled to the display panel 10. The data driving unit 12 has a plurality of data lines coupled to the display panel 10. The scan driving unit 11 outputs a plurality of scanning signals to the display panel 10, and conducts each column pixel set in order. Secondly, the data driving unit 12 also outputs a plurality of data signals to the display panel 10 to display a corresponding image on the display panel 10.

Such as in the traditional way, the scan driving unit 11 outputs the scanning signals on pixel sets to conduct thin-film transistors (TFT) of pixel sets in sequence with each row on the display panel 10. In other words, pixel sets on each row are driven by only one scanning signal within a period time. However, if the frequency of the outputted scanning signal is not high enough, the users will feel that the window of display panel 10 is flickering. More specifically, the scan driving unit 11 may scan the pixel sets from the first row, and the scanned pixel sets will be charged and initiate lighting. In response to the frequency of the scan signals outputted from the scan driving unit 11 being not high enough, the scan driving unit 11 does not complete scanning all pixel set rows, and the pixel sets on the first row may darken without receiving the new scanning signal. Thus, the above situation will reduce a user's comfort.

SUMMARY

The present disclosure provides a display device. The displaying device comprises a display panel, at least one scan driving unit and a data driving unit. The display panel is divided into a plurality of display regions respectively having a plurality of pixel sets. At least one scan driving unit having a plurality of scanning lines couples to the pixel sets. The at least one scan driving unit outputs a plurality of scanning signals to corresponding display regions upon receiving a first control signal. The data driving unit outputs a plurality of data signals to the corresponding display regions upon receiving a second control signal. In response to respectively receiving the first or second control signals, the scan driving unit outputs the scanning signals or the data driving unit outputs the data signals to the corresponding display regions thereby simultaneously scanning the display regions respectively having the pixel sets in sequence with corresponding scanning patterns.

The disclosure provides a method for a display device. The display includes a display panel, at least one scan driving unit, and a data driving unit. The display panel is divided into a plurality of display regions respectively having a plurality of pixel sets. The at least one scan driving unit has a plurality of scanning lines coupled to the pixel sets. The display method includes the following steps: respectively receiving a first control signal and a second control signal by the scan driving unit and the data driving unit; and in response to respectively receiving the first or second control signals, outputting the scanning signals by the scan driving unit or outputting the data signals by the data driving unit to the corresponding display regions thereby simultaneously scanning the display regions respectively having the pixel sets in sequence with corresponding scanning patterns to display an image.

To sum up, the display device and the method thereof provided by the present disclosure can divide the display panel into a plurality of display regions, and simultaneously scan those display regions in sequence with scanning patterns to display a corresponding image. Thus, the method provided by the embodiment is not affected by the frequency of the scanning signal outputted from the scan driving unit, so that the situation of the window of the display device flickering does not occur, to raise the comfort and visual perception when a user watches the window of the display device.

It is to be understood that both the foregoing general description and the following detailed description are examples, and are intended to provide further explanation of the invention as claimed.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1:
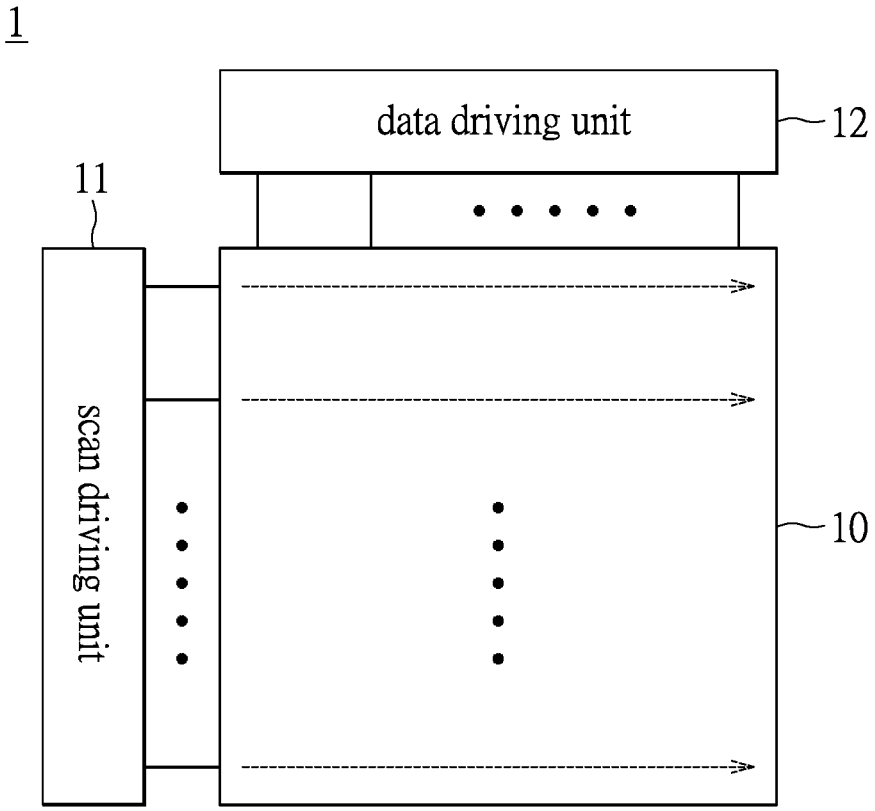
FIG.1 PRIOR ART
FIG. 1 is a schematic diagram illustrating a conventional display device.

Reference will now be made in detail to the present embodiments of the disclosure, examples of which are illustrated in the accompanying drawings. Wherever possible, the same reference numbers are used in the drawings and the description to refer to the same or like parts.

Figure 2:
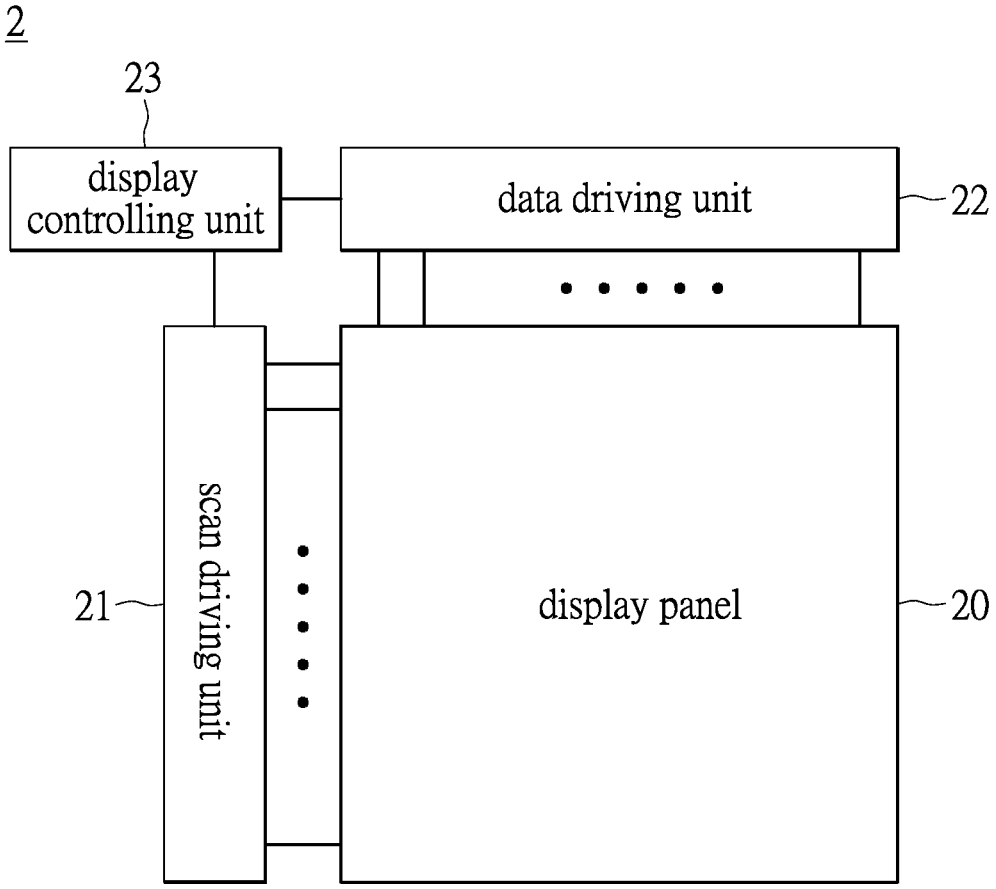
FIG. 2 is a schematic diagram illustrating a display device according to an embodiment.

Please refer to FIG. 2, which is a schematic diagram illustrating a display device according to an embodiment. The display device 2 includes a display panel 20, a scan driving unit 21, a data driving unit 22, and a display controlling unit 23. The scan driving unit 21 has a plurality of scanning lines coupled to the display panel 20, and the data driving unit 22 has a plurality of data lines coupled to the display panel 20. The scan driving unit 21 and the data driving unit 22 couple to the display controlling unit 23.

The display panel 20 is such as a Liquid Crystal Display (LCD) panel, which is composed of a plurality of pixel sets (not illustrated in FIG. 1). Each pixel set couples to the scan driving unit 21 by one scanning line. The pixel set includes a transistor and a capacitor. The gate of the transistor couples to the scan driving unit 21 by a corresponding scanning line. The source of the transistor couples to the data driving unit 22 by a corresponding data line. The drain of the transistor couples to the capacitor. The display panel 20 displays an image by controlling the conduction of each transistor and the charging/discharging of each capacitor.

The display controlling unit 23 is configured to receive image data corresponding to each image, and generate a first control signal and a second control signal to drive the scan driving unit 21 and the data driving unit 22.

The scan driving unit 21 is controlled by the first control signal outputted from the display controlling unit 23 thereby generating a plurality of scanning signals. In detail, the scan driving unit 21 operates to control logic levels and time periods for maintaining logic levels of the scanning signals according to the first control signal. The scan driving unit 21 outputs the scan signal to corresponding pixel sets to control conduction of the transistors of the pixel sets.

The data driving unit 22 is controlled by the second control signal outputted from display controlling unit 23, thereby generating a plurality of data signals. In detail, the data driving unit 22 operates to control logic levels and time periods for maintaining logic levels of the data signals according to the second control signal. The data driving unit 22 outputs the data signal according to the scanning signal to the corresponding pixel sets at the appropriate time.

Figure 3:
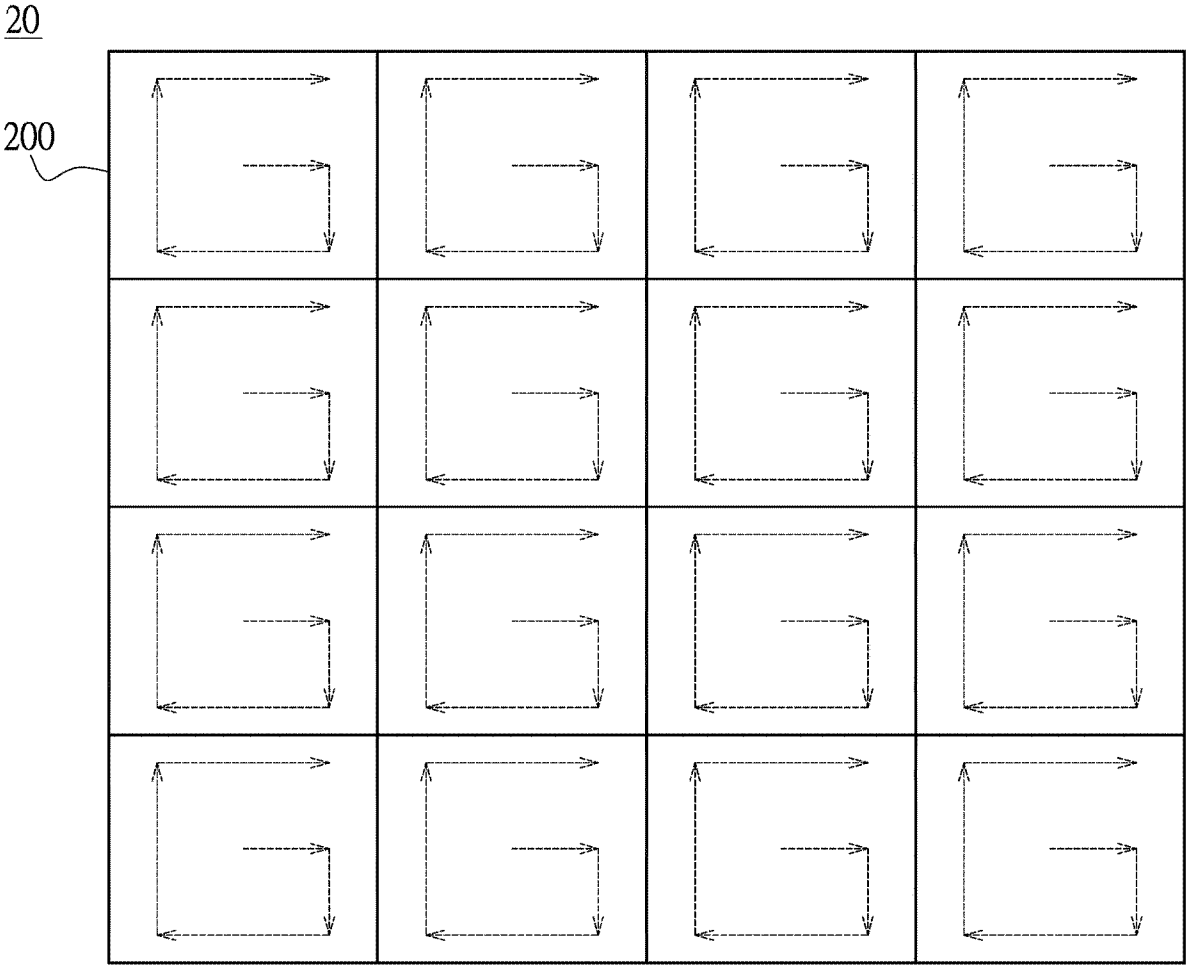
FIG. 3 is a schematic diagram illustrating a display panel according to an embodiment.

Please refer to FIG. 3, which is a schematic diagram illustrating a display panel according to an embodiment. The display panel 20 is divided into a plurality of display regions 200. Such as mentioned above, the display panel 20 includes a plurality of pixel sets (not illustrated in FIG. 3), and each pixel set couples to the scan driving unit (such as the scan driving unit 21 of FIG. 2) by one scanning line. Additionally, each display region 200 couples to the data driving unit by corresponding data lines (such as the data driving unit 22 of FIG. 2).

In the embodiment, each display region 200 has the same number of the pixel sets. However, the present disclosure is not limited thereto. In another embodiment, the display region 200 respectively can have a different number of the pixel sets.

For example, the display panel 20 is divided into 16 display regions 200. Each display region 200 includes nine pixel sets and forms a 3*3 pixel matrix. However, the embodiment is not limited to the number of the display regions 200 and the pixel sets thereto. In another embodiment, each display region 200 may include twelve pixel sets and form a 4*3 pixel matrix; or include sixteen pixel sets and form a 4*4 pixel matrix. Further each display region 200 may include a different number of pixel sets. In brief, persons skilled in the art can implement it according to design requirements or different situations. For the purpose of illustration, the present disclosure takes each display region 200 including nine pixel sets and forming the 3*3 pixel matrix for example. Each one of the pixel sets within display region 200 is coupled to the scan driving unit 21 by one scanning line. In other words, the display region 200 couples to the scan driving unit 21 by nine scanning lines. In addition, each display region 200 couples to the data driving unit 22 by three data lines. In other words, the pixel sets in the same column are coupled to the data driving unit 22 by the same data line.

Dividing the display panel 20 into a plurality of display regions 200 is operated by the display controlling unit 23. Users can regulate the size of display regions 200 by the display controlling unit 23 according to the requirements. The display device 2 also can set up a number of display regions 200 within the display panel 20 as a default.

After the display panel 20 has been divided into the display regions 200, the display controlling unit 23 decides scanning patterns respectively corresponding to each display region 200 (such as the dotted lines in FIG. 3). Each scanning pattern indicates the order that the scan driving unit 21 scans the pixels within a corresponding display region 200. The scanning pattern covers all pixels of the corresponding display region 200, that is, all the pixels of the display region 200 are scanned by the display controlling unit 23. After deciding the scanning patterns, the display controlling unit 23 outputs the first and second control signals corresponding to the scanning patterns thereby controlling the scan driving unit 21 and data driving unit 22 to respectively output the scanning signal and data signal to each display region 200. Thus, the display regions 200 are simultaneously scanned in sequence with corresponding scanning patterns to display the image.

The scanning pattern corresponding to each display region 200 can be preset by default. Thus, the display controlling unit 23 does not decide each display region 200 repeatedly. Such as in this embodiment, the scanning pattern corresponding to each display region 200 is the same with each other. In another embodiment, each display region 200 can differ from each other. The present disclosure is not limited thereto.

It is worth noting, in another embodiment, the display device (such as display device 2 in FIG. 2) also can include a plurality of the scan driving units. Those scan driving units are configured to scan different display regions 200. For example, the display device 2 includes a first scan driving unit and a second scan driving unit, and the first scan driving unit and the second scan driving unit are controlled by the display controlling unit 23. The first scan driving unit outputs a first scanning signal to control the display regions 200 within the first column and the second column of the display panel 20. The second scan driving unit outputs a second scanning signal to control the display regions 200 within the third column and the fourth column of the display panel 20. The display device of the embodiment can reduce loading of each scan driving unit by configuring a plurality of the scan driving units to control different display regions 200.

The forgoing embodiments are illustrations for explanation, which are not limited thereto. The person skilled in the art can implement according to the practice requirements or situations to design the number of the scan driving units within the display device 2, and how many of the display regions are controlled by each scan driving unit.

Figure 4:
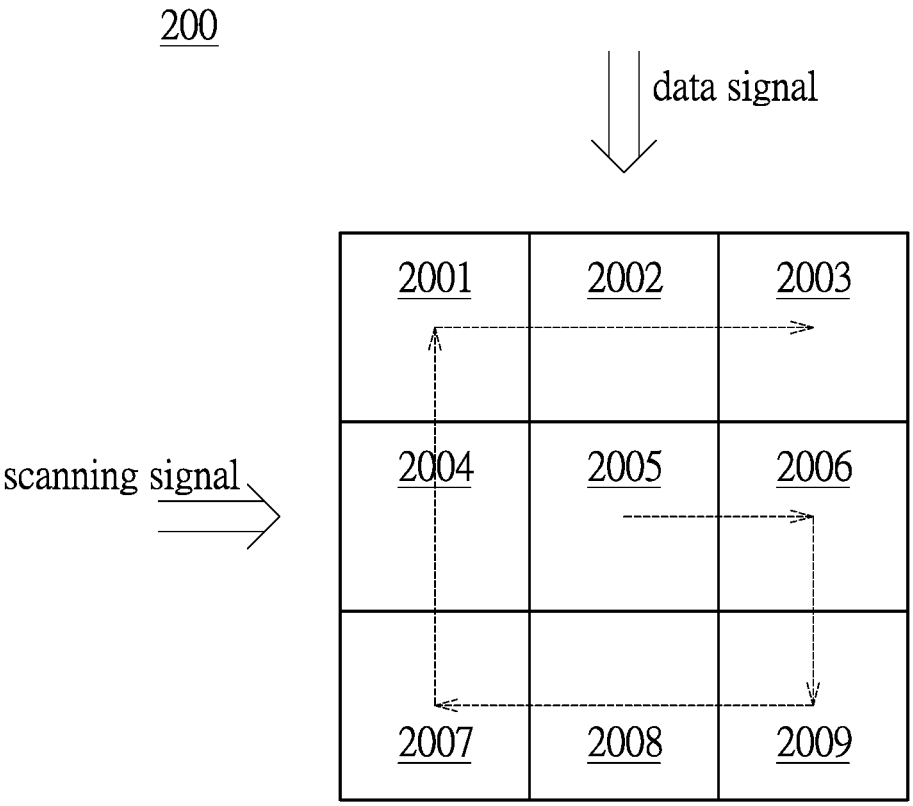
FIG. 4 is a schematic diagram illustrating a scanning pattern of the display panel according to an embodiment.

Please refer to FIG. 4, which is a schematic diagram illustrating a scanning pattern of the display panel according to an embodiment. In the embodiment, the scanning pattern shows an order which is from the inside out in a clockwise direction.

More specifically, the display region 200 includes pixel sets 2001-2009, and the arrangement of each pixel set is shown as FIG. 4. The pixel sets 2001-2009 respectively couple to the scan driving unit by one scanning line (not illustrated in FIG. 4). Please refer to FIG. 4 in conjunction with FIG. 2. The pixel set 2001 couples to the scan driving unit 21 by a first scanning line, the pixel set 2002 couples to the scan driving unit 21 by a second scanning line, the pixel set 2003 couples to the scan driving unit 21 by a third scanning line, the pixel set 2004 couples to the scan driving unit 21 by a fourth scanning line, the pixel set 2005 couples to the scan driving unit 21 by a fifth scanning line, the pixel set 2006 couples to the scan driving unit 21 by a sixth scanning line, the pixel set 2007 couples to the scan driving unit 21 by a seventh scanning line, the pixel set 2008 couples to the scan driving unit 21 by a eighth scanning line, and the pixel set 2009 couples to the scan driving unit 21 by a ninth scanning line.

Additionally, the pixel sets 2001, 2004, 2007 couple to the data driving unit 22 through the same data line such as a first data line. The pixel sets 2002, 2005, 2008 couple to the data driving unit 22 through the same data line such as a second data line. The pixel sets 2003, 2006, 2009 couple to the data driving unit 22 through the same data line such as a third data line. The order of the scanning pattern is shown as the dotted part in FIG. 4, which starts from the pixel set 2005 and from the inside out in the clockwise direction.

In sequence with the scanning pattern, the display controlling unit 23 outputs the first control signal to scan driving unit 21 and outputs the second control signal to data driving unit 22. The scan driving unit 21 and the data driving unit 22 respectively output the corresponding scanning signal and the corresponding data signal to the display region 200 thereby the pixel sets 2001-2009 launch lighting in sequence according to the scanning pattern.

Furthermore, for the purpose of making the pixel sets 2001-2009 launch lighting in sequence according to the scanning pattern, the scan driving unit 21 outputs a scanning signal of high logic level through the fifth scanning line to conduct the pixel set 2005. The data driving unit 22 outputs a data signal to the pixel set 2005 through the second data line and displays the corresponding image.

After the pixel set 2005 is scanned, the scan driving unit 21 outputs a scanning signal of high logic level through the sixth scanning line to conduct the pixel set 2006. The data driving unit 22 outputs a data signal to the pixel set 2006 through the third data line and displays the corresponding image.

After the pixel set 2006 is scanned, the scan driving unit 21 outputs a scanning signal of high logic level through the ninth scanning line to conduct the pixel set 2009. The data driving unit 22 outputs a data signal to the pixel set 2009 through the third data line and displays the corresponding image.

After the pixel set 2009 is scanned, the scan driving unit 21 outputs a scanning signal of high logic level through the eighth scanning line to conduct the pixel set 2008. The data driving unit 22 outputs a data signal to the pixel set 2008 through the second data line and displays the corresponding image.

After the pixel set 2008 is scanned, the scan driving unit 21 outputs a scanning signal of high logic level through the seventh scanning line to conduct the pixel set 2007. The data driving unit 22 outputs a data signal to the pixel set 2007 through the first data line and displays the corresponding image.

After the pixel set 2007 is scanned, the scan driving unit 21 outputs a scanning signal of high logic level through the fourth scanning line conduct the pixel set 2004. The data driving unit 22 outputs a data signal to the pixel set 2004 through the first data line and displays the corresponding image.

After the pixel set 2004 is scanned, the scan driving unit 21 outputs a scanning signal of high logic level through the first scanning line to conduct the pixel set 2001. The data driving unit 22 outputs a data signal to the pixel set 2001 through the first data line and displays the corresponding image.

After the pixel set 2001 is scanned, the scan driving unit 21 outputs a scanning signal of high logic level through the second scanning line to conduct the pixel set 2002. The data driving unit 22 outputs a data signal to the pixel set 2002 through the second data line and displays the corresponding image.

After the pixel set 2002 is scanned, the scan driving unit 21 outputs a scanning signal of high logic level through the third scanning line to conduct the pixel set 2003. The data driving unit 22 outputs a data signal to the pixel set 2003 through the third data line and displays the corresponding image.

To sum up the above, the display controlling unit 23 respectively controls the scan driving unit 21 and the data driving unit 22 by the first control signal and the second control signal. Therefore, the scan driving unit 21 and the data driving unit 22 respectively output the corresponding scanning signal and data signal to make the pixel sets 2005, 2006, 2009, 2008, 2007, 2004, 2001, 2002, and 2003 light in sequence with the scanning pattern.

The time of scanning the pixel sets 2005, 2006, 2009, 2008, 2007, 2004, 2001, 2002, and 2003 within the display region 200 in sequence with the scanning pattern is such as a scanning time period. After one scanning time period, the display controlling unit 23 controls the scan driving unit 21 and the data driving unit 22 to respectively output the scanning signal and the data signal to the display region 200 again. The display region 200 also makes the pixel sets 2005, 2006, 2009, 2008, 2007, 2004, 2001, 2002, and 2003 light in sequence with the scanning pattern again. In other words, the pixel sets of the display region 200 will launch lighting in sequence with the scanning pattern to display the corresponding image.

In each scanning time period, the display controlling unit 23 controls the scan driving unit 21 and the data driving unit 22 simultaneously to output the scanning signal and the data signal to all display regions 200 of the display panel (such as display panel 20 in FIG. 2). Each display region 200 simultaneously launches lighting in sequence with the scanning pattern to display the image. Thus, the window of the display device 2 will not look as flickering because the frequency of the scanning signals outputted from scan driving unit 21 is not high enough.

Figure 5A:
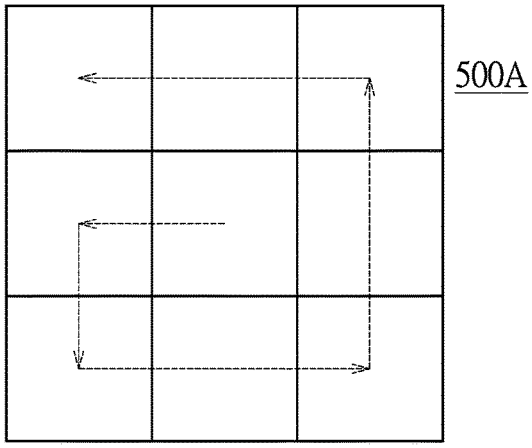
FIG. 5A-FIG. 5C are schematic diagrams illustrating other scanning patterns of the display panel according to an embodiment.
Figure 5B:
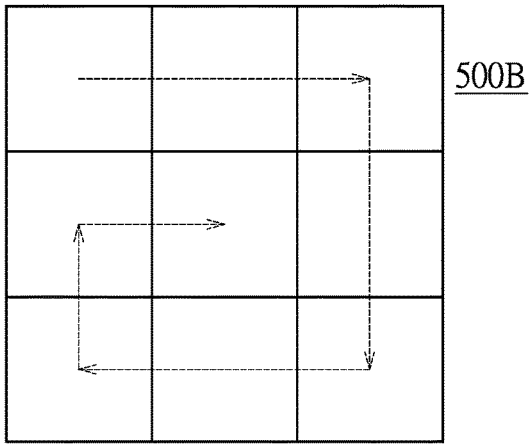
Figure 5C:
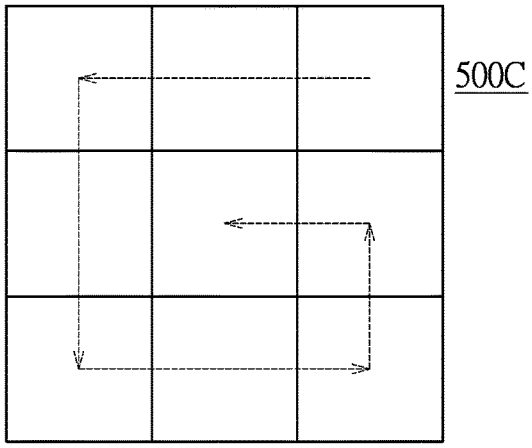

FIG. 5A-FIG. 5C are schematic diagrams illustrating other scanning patterns of the display panel according to an embodiment. Those embodiments are different from the embodiment of FIG. 4. The scanning pattern in FIG. 5A shows an order which is from the inside out, in an anticlockwise direction, the scanning pattern in FIG. 5B shows an order which is from the outside in, in a clockwise direction, and the scanning pattern in FIG. 5C shows an order which is from the outside in, in an anticlockwise direction.

It is worth noting, the scanning patterns of FIG. 5A-FIG. 5C are merely illustration, and are not limited thereto. The person skilled in the art can implement according to the practice requirements or situation to design the scanning pattern, so as to make the display region 200 of the display panel (such as the display panel 20 in FIG. 2) light in sequence with the scanning pattern and display the image.

Figure 6A:
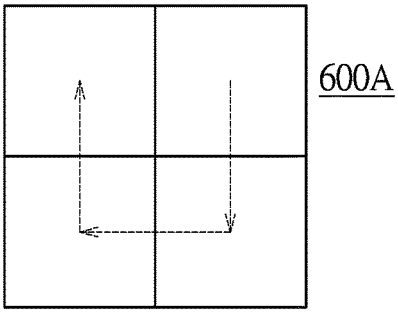
FIG. 6A-FIG. 6C are schematic diagrams illustrating other scanning patterns of the display panel according to an embodiment.
Figure 6B:
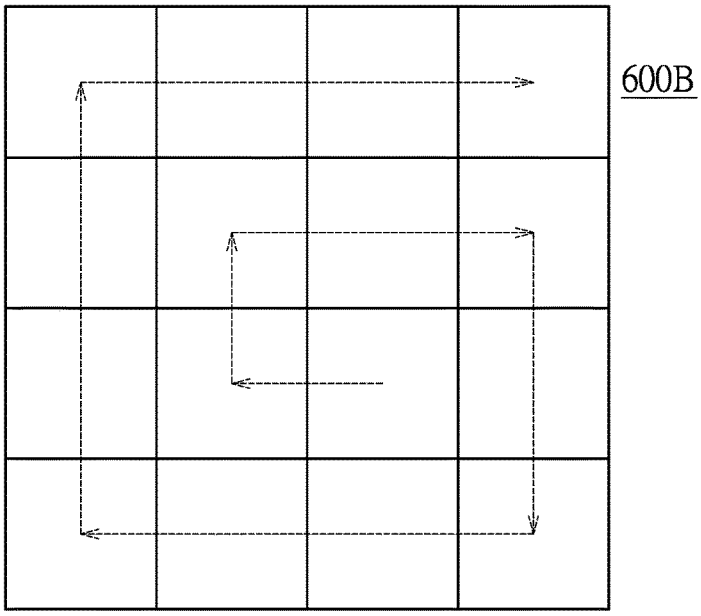
Figure 6C:
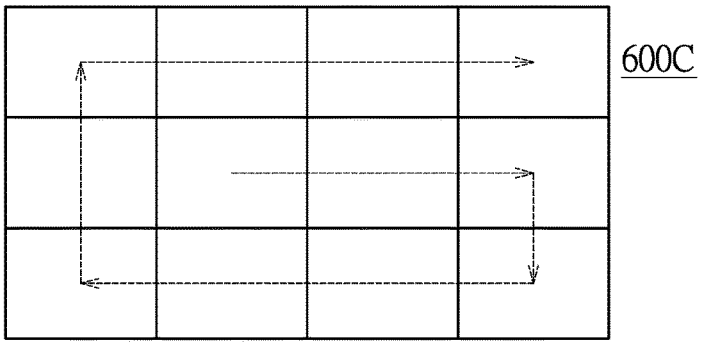

FIG. 6A-FIG. 6C are schematic diagrams illustrating other scanning patterns of the display panel according to an embodiment. These embodiments differ from the embodiments mentioned above, in that the display region 600A in FIG. 6A includes four pixel sets, and forms a 2*2 pixel matrix, the display region 600B in FIG. 6B includes sixteen pixel sets, and forms a 4*4 pixel matrix, and the display region 600C in FIG. 6C includes twelve pixel sets, and forms a 3*4 pixel matrix. The embodiments of the present disclosure are not limited to the size of the display region or the number of the pixel sets within the display region. The person skilled in the art can divide the display panel according to the practical situation or design requirements.

In addition, the scanning pattern of each display region 600A, 600B, and 600C is different from the embodiments mentioned above. Each scanning pattern of the display region 600A, 600B, and 600C is shown as FIG. 6A-FIG. 6C. It is worth noting, the scanning patterns of FIG. 6A-FIG. 6C are merely illustration for explanation, and are not limited thereto. The person skilled in the art may reference the embodiments said above and design other different scanning patterns.

It is worth noting, the scanning patterns of the forgoing embodiments show the order where the pixel sets are scanned neighbor by neighbor. However, the present disclosure is not limited thereto. In another embodiment, the scanning patterns also can be non-continuous. Such as the pixel sets 2001-2009 in FIG. 4, the scanning pattern can indicate that the display controlling unit first scans the pixel set 2009 and then scans the pixel set 2001. That is, the next scanned pixel set is not the neighbor of the pixel set 2009 (e.g., pixel sets 2006, 2008).

Figure 7:
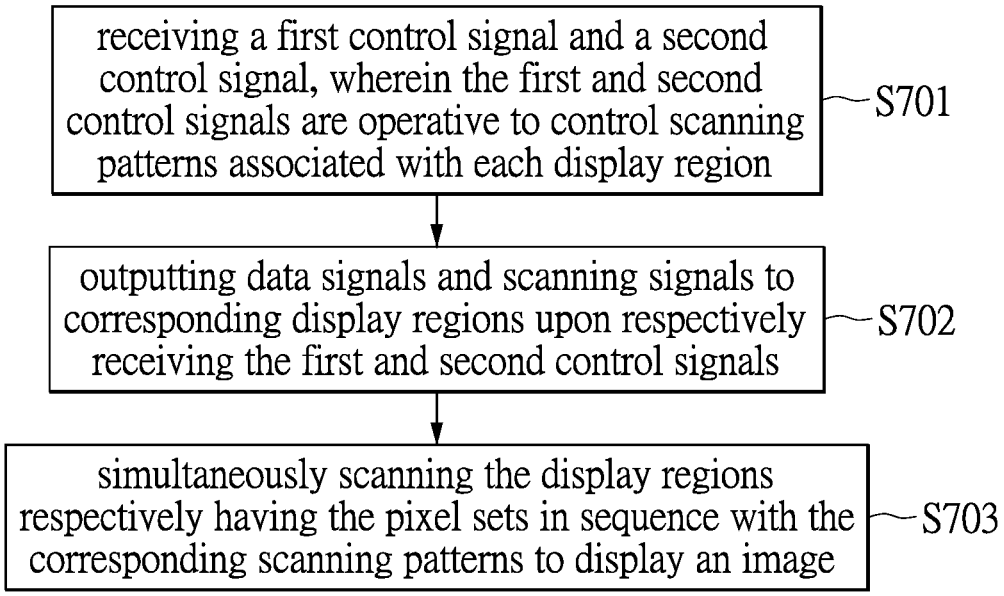
FIG. 7 is a flow chart illustrating a method for displaying according to the embodiment.

Please refer to FIG. 7, which is a flow chart illustrating a method for displaying according to the embodiment. The method is adapted for the display device described above (such as the display device 2 in FIG. 2). The display device includes a display panel, a scan driving unit and a data driving unit. The display panel is divided into a plurality of display regions. Each display region includes a plurality of pixel sets. Each pixel set couples to the scan driving unit by one scanning line. Each size of the display region is configured to be the same with each other or different from each other. In the step S701, the scan driving unit and the data driving unit respectively receive a first control signal and a second control signal that are outputted from the display controlling unit, wherein the first and second control signals are operative to control scanning patterns associated with each display region. Each display region having the pixel sets is scanned in sequence with a corresponding scanning pattern. However, each scanning pattern of the display region can be designed to be the same with each other or be different from each other.

In the step S702, the scan driving unit and the data driving unit output a plurality of data signals and a plurality of scanning signals to corresponding display regions upon respectively receiving the first and second control signals. In the step S703, the display regions respectively having the pixel sets are simultaneously scanned in sequence with the corresponding scanning patterns to display an image.

By going through the above stages, the display device and the method thereof provided by the present disclosure can divide the display panel into a plurality of display regions, and simultaneously scan those display regions in sequence with scanning patterns to display a corresponding image. In other words, the display device and the method thereof provided by the present disclosure is not affected by the frequency of scanning signal outputted from the scan driving unit, and the situation of the window of the display device flickering does not occur. Additionally, the display method is adapted to various display devices for increasing the comfort and visual perception when a user watches the display device.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A display device, comprising:

a display panel, being divided into a plurality of display regions that form a M*N matrix of display regions where M and N are integers equal to or larger than 2, and each of the plurality of display regions being composed of a plurality of pixel sets, which form a matrix of pixel sets, wherein each of the plurality of display regions is separately controlled by a display controlling unit of the display device;

at least one scan driving unit, having a plurality of scanning lines coupled to the pixel sets, operatively configured for outputting a plurality of scanning signals to corresponding display regions upon receiving a first control signal, wherein the pixel sets in different display regions are coupled to the scan driving unit via different scanning lines; and a data driving unit, coupled to the display panel, operatively configured for outputting a plurality of data signals to the corresponding display regions upon receiving a second control signal;

wherein, the display controlling unit is coupled to the scan driving unit and the data driving unit, and is operatively configured to separately define multiple scanning patterns that are respectively associated with the plurality of matrix-formed display regions having the pixel sets;

wherein every scanning pattern is scanned in an order which is from the inside out in a clockwise direction or in a counterclockwise direction and covers all pixels of the corresponding display region; according to the scanning pattern, the display controlling unit generates the first control signal to control the at least one scan driving unit and the second control signal to control the at least one data driving unit; and wherein, in each scanning time period, the display controlling unit controls the at least one scan driving unit and the at least one data driving unit simultaneously to output the scanning signals and the data signals to all display regions of the display panel, and the display regions are simultaneously launched to light with respective scanning patterns to display an image, and therefore the image does not flicker even if the frequency of the scanning signals outputted from the at least one scan driving unit is not high enough.

2. The display device of claim 1, wherein the display device is an LED (Light-Emitting Diode) display.

3. The display device of claim 1, wherein the scan driving unit and the data driving unit respectively operate to control logic levels and time periods of maintaining logic levels according to the first and second control signals.

4. The display device of claim 1, wherein the size of the display regions are equal to each other.

5. The display device of claim 1, wherein the scanning patterns are the same.

6. A display method for a display device, the display device comprising a display panel, at least one scan driving unit, and a data driving unit, wherein the display panel is divided into a plurality of display regions that form a M*N matrix of display regions where M and N are integers equal to or larger than 2, and each of the plurality of display regions being composed of a plurality of pixel sets, which form a matrix of pixel sets, wherein each of the plurality of display regions is separately controlled by a display controlling unit of the display device, the at least one scan driving unit has a plurality of scanning lines coupled to the pixel sets and the pixel sets in different display regions are coupled to the scan driving unit via different scanning lines, the display method comprising:

STEP A: respectively receiving a first control signal and a second control signal by the scan driving unit and the data driving unit, wherein the display controlling unit is coupled to the scan driving unit and the data driving unit, and is operatively configured to separately define multiple scanning patterns that are respectively associated with the plurality of matrix-formed display regions, wherein every scanning pattern is scanned in an order which is from the inside out in a clockwise direction or in a counterclockwise direction and covers all pixels of the corresponding display region; according to the scanning pattern, the display controlling unit generates the first control signal to control the at least one scan driving unit and the second control signal to control the at least one data driving unit; and STEP B: in each scanning time period, the display controlling unit controls the at least one scan driving unit and the at least one data driving unit simultaneously to output scanning signals and data signals to all display regions of the display panel, and the display regions are simultaneously launched to light with respective scanning patterns to display an image, and therefore the image does not flicker even if the frequency of the scanning signals outputted from the at least one scan driving unit is not high enough.

7. The display method of claim 6, wherein the display device is an LED (Light-Emitting Diode) display.

8. The display method of claim 6, wherein the scan driving unit and the data driving unit respectively operate to control logic levels and time periods for maintaining logic levels according to the first and second control signals.

9. The display method of claim 6, wherein the size of the display regions are equal to each other.

10. The display method of claim 6, wherein the scanning patterns are the same.

* * * * *